US005204142A

United States Patent [19]

Okumura

[11] Patent Number: 5,204,142

[45] Date of Patent: Apr. 20, 1993

[54] METHOD FOR INTEGRALLY FORMING A CUTTER ON A CARTON BLANK

[75] Inventor: Eitaro Okumura, Kyoto, Japan

[73] Assignee: Ayako Okumura, Kyoto, Japan

[21] Appl. No.: 643,286

[22] Filed: Jan. 22, 1991

[30] Foreign Application Priority Data

Jan. 22, 1990 [JP] Japan ..... 2-4473
Mar. 1, 1990 [JP] Japan ..... 2-50775[U]

[51] Int. Cl.[5] ..... B05D 3/12; B05D 5/00

[52] U.S. Cl. ..... 427/285; 225/49; 427/290; 493/56

[58] Field of Search ..... 427/285, 290; 493/56, 493/361, 362; 225/49

[56] References Cited

U.S. PATENT DOCUMENTS

| | | | |
|---|---|---|---|
| 3,281,036 | 10/1966 | Woodling | 225/49 |
| 3,479,203 | 11/1969 | Broadhurst | 427/290 X |
| 4,234,635 | 11/1980 | Atkinson | 428/80 |
| 4,272,590 | 6/1981 | Blank | 428/460 |
| 4,371,104 | 2/1983 | Korte | 225/48 |
| 4,386,193 | 5/1983 | Reich et al. | 526/298 |
| 4,856,502 | 8/1989 | Ersfeld et al. | 427/2 X |

FOREIGN PATENT DOCUMENTS

| | | |
|---|---|---|
| 47-34588 | 10/1972 | Japan . |
| 1114532 | 11/1972 | Japan . |
| 48-36392 | 11/1973 | Japan . |
| 1-294429 | 11/1989 | Japan . |

*Primary Examiner*—Evan Lawrence
*Attorney, Agent, or Firm*—Cushman, Darby & Cushman

[57] ABSTRACT

A paperboard shaped into a profile substantially the same as that of a carton blank for folding into a carbon is formed with a plurality of first slits on an edge of the paperboard at a predetermined angle relative to the edge and with a plurality of second slits on the same edge at a predetermined angle relative to the first slits in such a manner that saw-teeth are integrally formed thereon. The saw-teeth are immersed in a bath of a quick drying adhesive including α-cyanoacrylate to be impregnated with the adhesive and then dried, thereby forming teeth constituting a cutter on the carton blank. The carton obtained by folding the carton blank can be used as a packaging container for accommodating a roll of wrapping web. An apparatus for carrying out the method comprises a first group of cutting blades for forming the first slits, a second group of cutting blades for forming the second slits so as to integrally form saw-teeth on the edge portion, a bath of adhesive for impregnating the teeth with the adhesive, a dryer for drying the teeth, and a transfer device for transferring the paperboard along a predetermined path via the first and second groups of cutting blades, the bath and the dryer.

5 Claims, 9 Drawing Sheets

METHOD FOR INTEGRALLY FORMING A CUTTER ON A CARTON BLANK

BACKGROUND OF THE INVENTION

The present invention relates to a method and apparatus for integrally forming a cutter on a carton blank to be folded into a carton. More specifically, the present invention relates to such a method in which a paperboard is shaped into a profile substantially the same as the carton blank, the paperboard is integrally formed with saw-teeth on an edge portion thereof and the teeth are hardened by an application of a quick drying adhesive including α-cyanoacrylate, thereby producing a carton blank for folding into a carton having an integral cutter; and an apparatus for performing the above method.

A variety of containers for accommodating a wrapping web, such as wrapping film, aluminum foil or thin paper sheet for wrapping foods, drugs and the like, are well known. Exemplary of such containers are wrapping web containers constituted as cartons made of, for instance, paperboard having a thickness of approximately 0.3–0.5 mm, and capable of accommodating a roll of wrapping web so as to be freely rotatable therein. Such cartons are provided with metallic cutters for transversely severing web portions unrolled and extracted from the web roll by the user.

In Japanese Utility Model Application No. 63-10064, the present inventor has proposed a cutter defined by saw-teeth hardened by application of a quick drying adhesive including α-cyanoacrylate. One cutter of this type is formed directly on an edge portion of a front wall of a carton blank for forming the carton. The cutter is used instead of the conventional metallic cutter for cutting a wrapping web on the upper edge of the carton box. In the process of forming the cutter, a carton board having a profile generally corresponding to the final carton is fabricated from fiberboard or paperboard, and a series of cutting teeth, like saw teeth, is integrally formed on an edge of the carton board by a blanking or die-cutting process. A quick drying adhesive including α-cyanoacrylate is then applied to the toothed edge, so that the toothed edge is hardened by the adhesive to a degree enabling it to cut the wrapping web.

While the above-described process fulfills its purpose, it has been found that where the toothed edge is made in a single step in which the carton board is cut by a conventional blanking tool or die cutter having a saw teeth profile, the apex of each tooth is compressed and partially deformed by the die-cutting pressure. This deformation may cause the apex to be rounded and thinned to such an extent that the toothed edge will not maintain the required strength.

Moreover, small pieces of paper and dust generated in the blanking or die-cutting process remain on the toothed edge and are entrained thereby. Such pieces and dust may contaminate a bath of the adhesive in which the toothed edge is immersed following the blanking process. Otherwise, the pieces and dust remain adhered to the toothed edge and degrade the appearance and quality of the finished cutter.

Further, while the fabrication of the cutter in the aforesaid manner enables the carton to be produced in a relatively short time because the adhesive dries naturally and cures quickly to impart the toothed edge with adequate strength, a further shortening of the drying time is desirable in view of the requirements ragarding mass-production of the carton blanks.

In addition, since no apparatus for carrying out the above method automatically and successively has been developed, it has not been possible to economically mass-produce carton blanks with integral cutters.

SUMMARY OF THE INVENTION

Accordingly, an object of the present invention is to provide a method of integrally forming a cutter on a carton blank, which enables formation of a toothed edge with desired strength.

Another object of the present invention is to provide a method of integrally forming a cutter on a carton blank which can prevent small pieces of paper and dust generated in the blanking or die-cutting process from remaining on the toothed edge and from being entrained by the edge.

Another object of the present invention is to provide a method of integrally forming a cutter on a carton blank which endbles the drying time to be minimized.

Another object of the present invention is to provide an apparatus for integrally forming a cutter on a carton blank, which enables economical mass-production of carton blanks with integral cutters.

To these ends, according to one aspect of the present invention, there is provided a method of integrally forming a cutter on a carton blank in which a paperboard is shaped into a profile substantially the same as that of the carton blank, the paperboard is integrally formed with saw-teeth on an edge portion thereof, and the teeth are hardened by application of a quick drying adhesive including α-cyanoacrylate, thereby producing a carton blank for a carton having an integral cutter, comprising:

forming a plurality of first slits on an edge portion of said paperboard at a predetermined angle relative to the edge;

forming a plurality of second slits on said edge portion of the paperboard at a predetermined angle relative to the first slits in such a manner that saw-teeth are formed on the edge; and hardening the teeth by application of said quick drying adhesive.

Preferably, the method further includes the steps of sucking up small pieces of paper and dust generated in the blanking or die-cutting process, thereby removing the pieces and dust from said edge portion of the paperboard.

According to another aspect of the present invention, there is provided a method of integrally forming a cutter on a carton blank in which the a paperboard is shaped into a profile substantially the same as that of the carton blank, the paperboard is integrally formed with saw-teeth on an edge portion thereof, and the teeth are hardened by application of a quick drying adhesive including α-cyanoacrylate, thereby producing a carton blank for a carton having an integral cutter, comprising:

cutting the paperboard so as to form saw-teeth on an edge portion of the paperboard;

immersing said edge portion of the paperboard formed with the teeth in a bath of said quick drying adhesive to impregnate the edge portion with the adhesive;

blowing air over the edge portion to remove drops of the quick drying adhesive therefrom; and drying said edge portion to instantly harden the teeth.

The adhesive in said bath is preferably circulated so as to maintain its fluidity.

According to a further aspect of the present invention, there is provided an apparatus for integrally forming a cutter on a carton blank comprising:

first cutting means for forming a plurality of first slits on an edge portion of a paperboard at a predetermined angle relative to the edge;

second cutting means for forming a plurality of second slits on said edge portion of the paperboard at a predetermined angle relative to the first slits in such a manner that saw-teeth are formed on the edge;

a bath of a quick drying adhesive including α-cyanoacrylate, in which said edge portion is immersed to impregnate said teeth with the adhesive; and a transfer means for transferring said edge portion along a predetermined path via said first and second cutting means and said bath.

Preferably, the apparatus further includes a collector for sucking up small pieces of paper and dust generated in the blanking or die-cutting process so as to remove the pieces and dust from the edge portion.

According to still further aspect of the present invention, there is provided an apparatus for integrally forming a cutter on a carton blank comprising:

cutting means for forming saw-teeth on an edge portion of a paperboard;

a bath of a quick drying adhesive including α-cyanoacrylate, in which said edge portion is immersed to impregnate said teeth with the adhesive;

blowing means for blowing air over the edge portion to remove drops of the quick drying adhesive therefrom; and drying means for drying the edge portion having been immersed in said bath so that the teeth are hardened immediately;

a transfer means for transferring said edge portion along a predetermined path via said cutting means, said bath, said blowing means and said drying means.

Preferably, the bath is provided with means for circulating the adhesive so as to allow the adhesive to maintain its fluidity.

The carton blank with the cutter made in accordance with the present invention can be folded into a carton for use as a packaging container for accommodating a roll of wrapping web.

These and other objects, features and advantages of the present invention will become apparent from the following description of the preferred embodiments when the same is read in conjunction with the accompanying drawings.

BRIEF DESCRIPTION OF THE DRAWINGS

FIG. 3 is a vertical cross-sectional view of the packaging container shown in FIG. 3.

DESCRIPTION OF THE PREFERRED EMBODIMENTS

Preferred embodiments of a method and apparatus according to the present invention will be described hereinafter with reference to the accompanying drawings.

Figure 1:
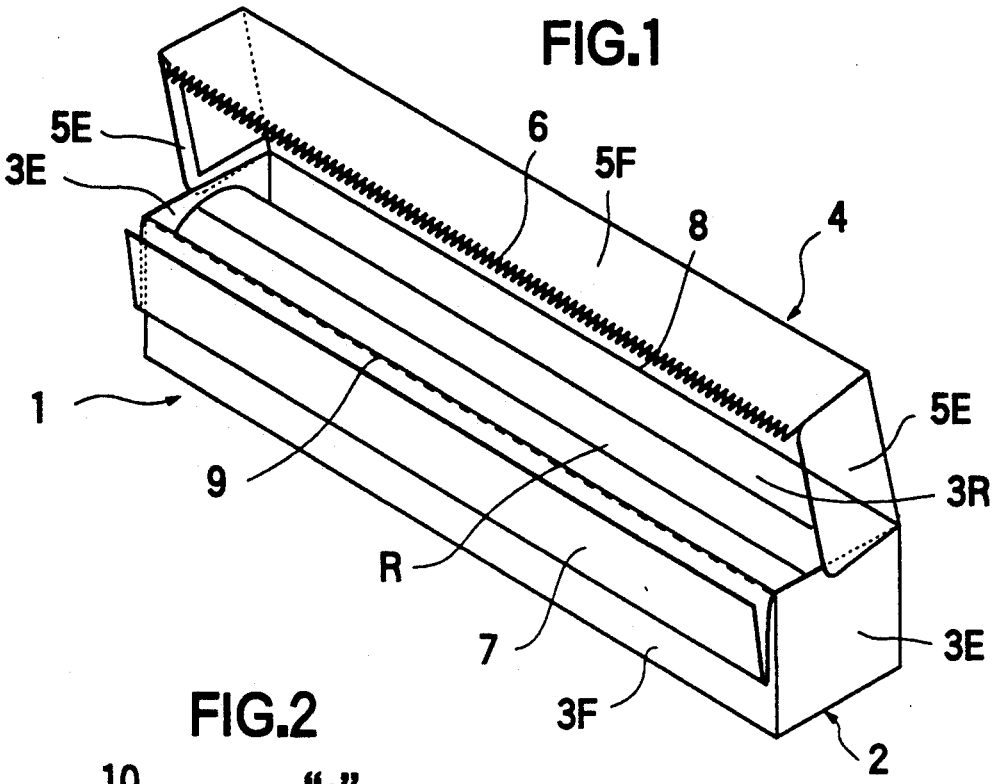
FIG. 1 is a perspective view of a packaging container which is fabricated from a carton blank produced by the method of the present invention.
Figure 1A:
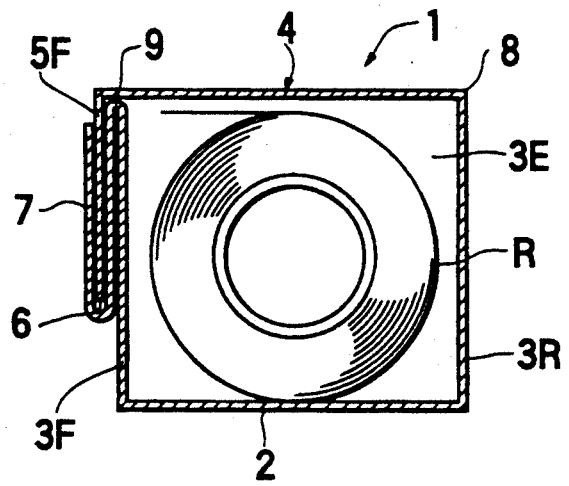
FIGS. 1A and 1B are vertical cross-sectional views of the packaging container shown in FIG. 1.

Referring to FIGS. 1 and 1A, there is shown a packaging container 1 constituted as a carton made from a carton blank, which is used as a container for a roll R of wrapping web such as food wrapping film and which accommodates the roll R so as to enable the web freely unrolled and extracted thereform. The packaging container 1 includes a bottom plate 2, a front side wall 3F, a rear side wall 3R and end walls 3E, 3E. The walls 3F, R, 3E stand upright along the edges of the bottom plate 2. The packaging container 1 also includes a lid 4 extending forward from the upper edge of the rear side wall 3R, and the lid 4 has a front skirt 5 F and end skirts 5E,5E depending from its front and end edges. The front skirt 5F is integrally formed with cutter 6 at its lower edge. Further, the front wall 3F is provided with a cover plate 7 secured to the upper edge of the front wall 3F and extending downward therefrom.

As shown in FIG. 1A, the cover plate 7 extends down to the cutter 6 and then doubles back upwardly to have its leading end portion adhered to the outside surface of the front skirt 5F in a manner which allows it to be readily separated therefrom. Thus, the cover plate 7 encloses the cutter 6 to protect it from damage and contamination during transport and before use.

Figure 1B:
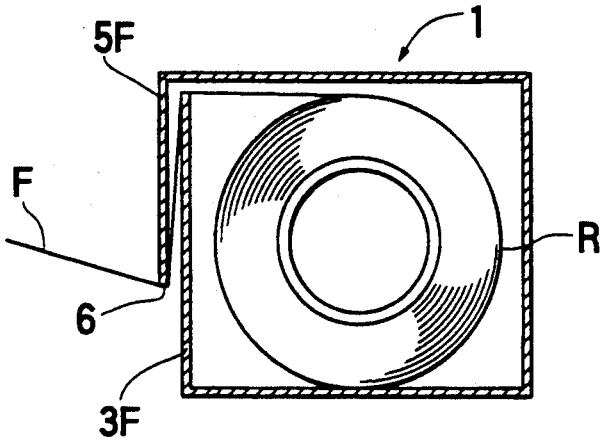

The bottom plate 2, the front and rear walls 3F, 3R and the end walls 3E, 3E define an open-top container which can rotatably accommodate the roll of wrapping web R. Further, the lid 4 is mounted on the rear wall 3R through a folding line 8 formed along the upper edge thereof so that the lid 4 can swing about the upper edge. The lid 4 defines a closure of the open-top container together with the front and end skirts 5F, 5E. The lid 4 is normally closed. A series of spaced apertures or perforations 9 are formed along the upper edge of the front wall 3F so that the cover plate 7 can be removed from the front wall 3F by tearing along the perforations 9 immediately before the wrapping web is used. As shown in FIG. 1B, the wrapping web portion F unrolled and extracted from the roll R can be severed transversely and separated therefrom by the cutter 6.

Figure 2:
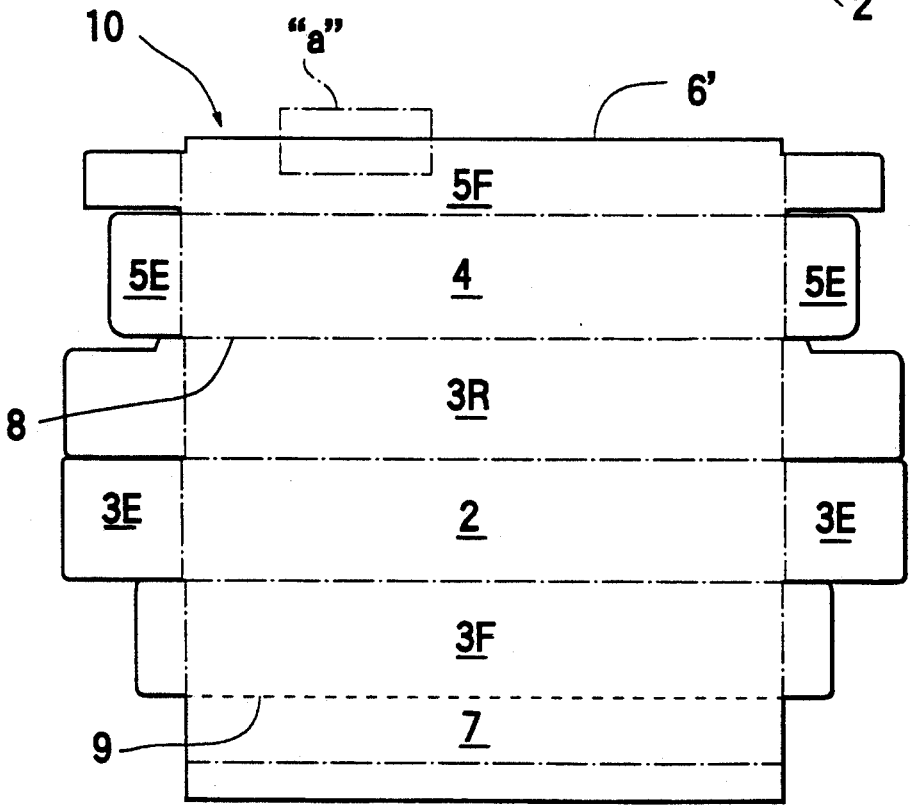
FIG. 2 is a plan view of the carton blank used to fablicate the container shown in FIG. 1, the carton blank being shown prior to be formed with the cutter.

Referring to FIG. 2, there is shown a carton blank 10 to be folded into the form of the packaging container 1. The carton blank 10 is produced from a preselected paperboard by blanking or die-cutting and pressing. It has a profile corresponding to the configuration of the packaging container 1 and comprises all of the folding lines including the folding line 8 (as shown in phantom lines) as well as the spaced perforations 9 as shown by a dotted line. However, the carton blank 10 does not have the cutter 6. To distinguish it from the carton blank 10 provided with a cutter, it will therefore be referred to as a "carton board 10".

The carton board 10 has an edge portion 6, on which the cutter 6 is to be formed. In the preceding die-cutting process the edge portion 6' is cut straight to lie parallel with the longitudinal axis of the carton.

Figure 3A:
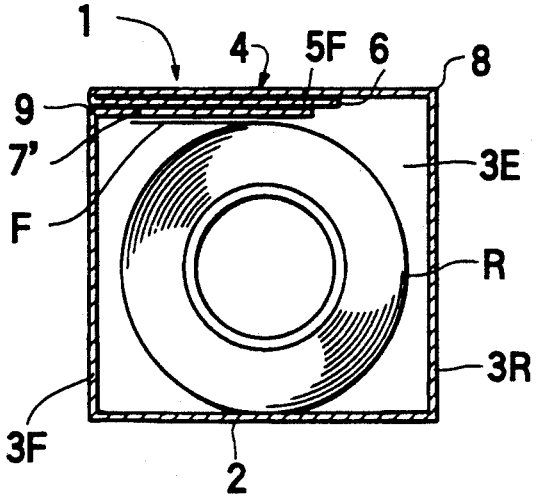
FIG. 3 is a perspective view of a packaging container of a different type from that shown in FIG. 1, also produced by the method of the present invention.
Figure 3:
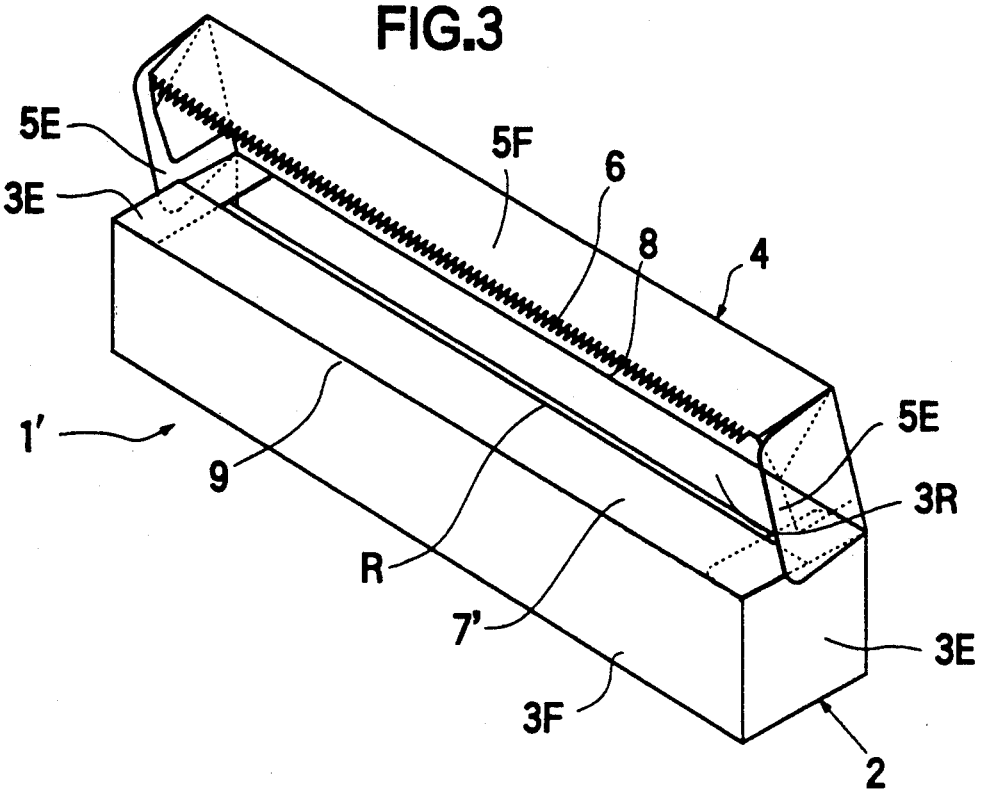
Figure 4:
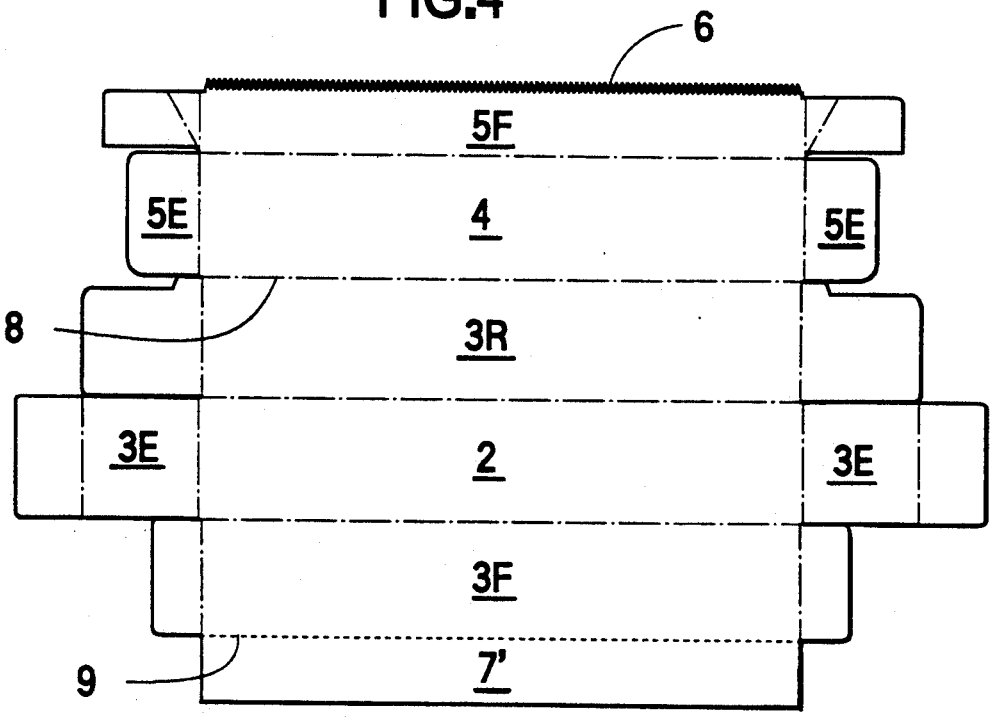
FIG. 4 is a plan view of the carton blank used to fablicate the container shown in FIG. 3, the carton blank being shown after being formed with the cutter.

FIG. 3 shows a packaging container 1' of a different type from the above packaging container 1 and being formed with the cutter 6, and FIG. 4 shows a carton blank 10 used to fablicate the packaging container 1'. In FIG. 3, each portion or part substantially the same as a portion or part shown in FIGS. 1 and 2 is indicated by the same reference numeral.

The packaging container 1' is of a construction substantially the same as said packaging container 1 except that the container 1, is provided with a cover plate 7' secured to an upper edge of the front wall 3F and extending horizontally and rearward therefrom. As shown in FIG. 3A, before the packaging container 1 is used, the cover plate 7' is placed under the front skirt 5F so as to support the skirt 5F for keeping the cutter 6 in position and, therefore, the cover plate 7' can prevent the skirt 5F from lowering and damaging the wrapping web of the roll and can also prevent the cutting tool 6 from damage and contamination during transport and before use. In use, the cover plate 7 is removed from the front wall 3F of the packaging container 1 by tearing along the perforations 9, thus allowing the wrapping web portion F to be unrolled and extracted smoothly from the roll R.

Figure 2A:
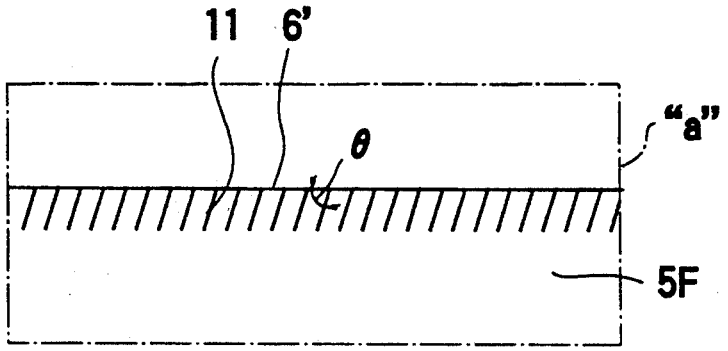
FIGS. 2A, 2B and 2C are explanatory representations showing process steps for forming a cutter on the carton blank.
Figure 2B:
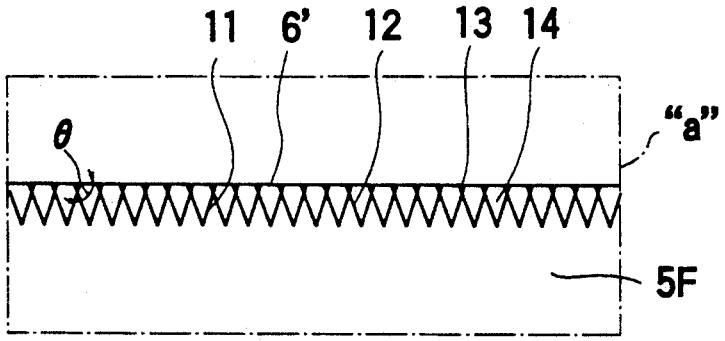
Figure 2C:
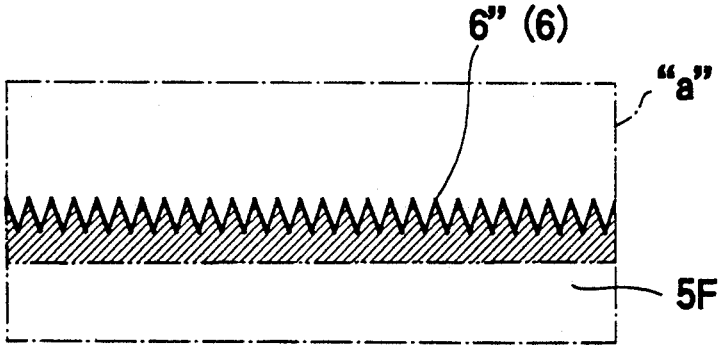

FIGS. 2A, 2B and 2C are explanatory representations showing the process steps for forming the cutter 6. The portion of the carton board 10 designated by "a" in FIG. 2 is illustrated on an enlarged scale. In the first stage of the processes, the edge portion 6' is formed by die-cutting with a plurality of slits 11 spaced a predetermined distance from each other, as shown in FIG. 2A. The slits 11 are arranged parallel with each other at an angle Θ relative to the edge portion 6' as measured anticlockwisely.

In the second stage, the edge portion 6, is formed by die-cutting with a plurality of slits 12 spaced a predetermined distance from each other. The slits 12 are formed in substantially the same number and at the same spacing as the slits 11. The slits 12 are arranged parallel with each other at the angle Θ relative to the edge portion 6' as measured clockwisely.

The cutting of the slits 11 and 12 causes small pieces of paper 13, 14 to be cut out of the front skirt 5F and these pieces 13, 14 are removed from the edge portion 6' by a dust collector (not shown) together with lint -like swarfs or dust.

Thus, the edge portion 6' is formed with saw-toothed edge whose tooth apices are formed at the intersections of the slits 11 and 12. In this process, the compression provided by the die-cutting pressure does not exert a large force on the apices because the toothed edge is made in two steps in which the carton board is first cut in one direction and then cut in another direction, rather than in a single step as in the conventional method. Therefore, the apices are not rounded or thinned, so that the toothed edge can be imparted with the desired strength and sharpness. Further, small pieces of paper 13, 14 and dust generated in the blanking or die-cutting process are removed by the dust collector and do not remain on the toothed edge. Therefore, since such pieces and dust will not be entrained by the edge, they will not contaminate the bath of quick drying adhesive in an immersing process following the blanking process. Their removal also enhances the appearance and quality of the integral cutter 6.

Next, the toothed edge portion 6 of the carton board 10 is dipped or immersed in a bath of a quick drying adhesive up to a predetermined depth as shown by the shaded region in FIG. 2C, for a predetermined time, for example, two or there seconds, so that the edge portion 6' is impregnated with the adhesive. An α-cyanoacrylate is preferably used as the quick drying adhesive, and the following α-cyanoacrylates may be used as examples; ethyl α-cyanoacrylate, 1-methylheptyl α-cyanoacrylate, i-propyl α-cyanoacrylate, i-butyl α-cyanoacrylate, s-butyl α-cyanoacrylate, butyl α-cyanoacrylate, 2-ethylhexyl α-cyanoacrylate, 1-ethylpropyl α-cyanoacrylate, neopentyl α-cyanoacrylate, 2,2-dimethylbutyl α-cyanoacrylate, cyclohexyl α-cyanoacrylate, allyl α-cyanoacrylate, propyl α-cyanoacrylate, methyl α-cyanoacrylate, methoxyethyl α-cyanoacrylate, ethoxyethyl α-cyanoacrylate, 2-chloroethyl α-cyanoacrylate, ethoxycarbomethyl α-cyanoacrylate, trifluoroethyl α-cyanoacrylate, 1-cyanocarbomethoxybutadiene-1, 3, 1-cyanocarboethoxybutadiene-1,3, 1-cyanocarboisobutoxybutadiene-1,3, ethylene glycol-bis(α-cyanoacrylate), trans-2-buten-1,4-diol bis(α-cyanoacrylate), 2,5-hexanediol bis(α-cyanoacrylate), ethyleneglycol di(1-cyanobutadiene-1,3) carboxylic acid ester, propyleneglycol di(1-cyanobutadiene-1,3) carboxylic acid ester, diethyleneglycol di(1-cyanobutadiene-1,3)carboxylic acid ester and the like.

The saw-teeth-shaped edge portion 6'' thus impregnated with the adhesive is placed in an air current of relatively high velocity instantaneously, so that drops of residual adhesive remaining at the bottoms of the V-shaped notches are removed therefrom. Thereafter, the saw-toothed edge portion 6'' is dried in a hot air current, e.g. in a laminer flow of air at the temperature of 100° C. In this manner, the edge portion 6'' is formed into the cutter 6 of a hardness sufficient to cut the wraping web F. Since the toothed edge is dried by a hot air current, the time required for drying is substantially shortened. This allows the overall production process to meet the requirements for mass-production of the carton blanks. Further, the removal of the drops enhances the appearance and quality of the cutter 6.

Figure 5:
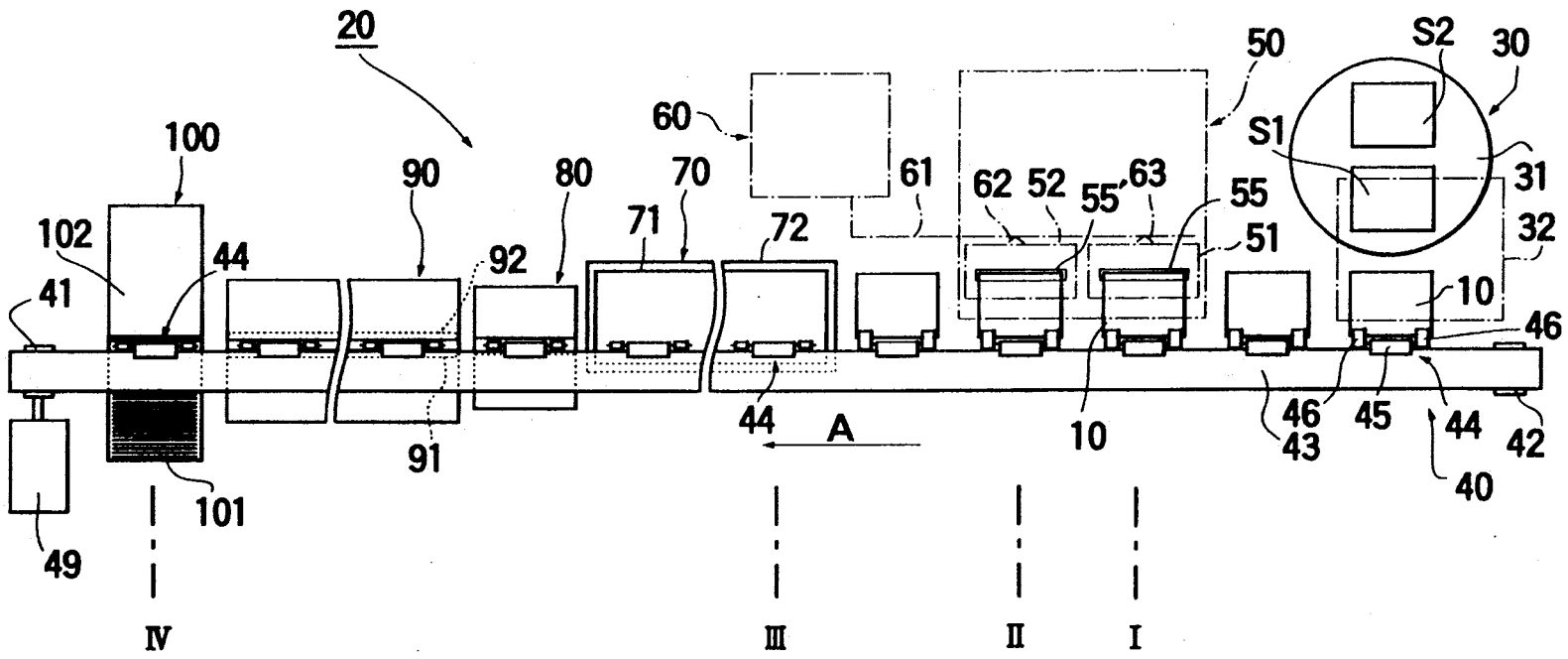
FIGS. 5 and 6 are a schematic plan view and a schematic side elevational view showing a apparatus for forming an integral cutter according to the present invention.
Figure 6:
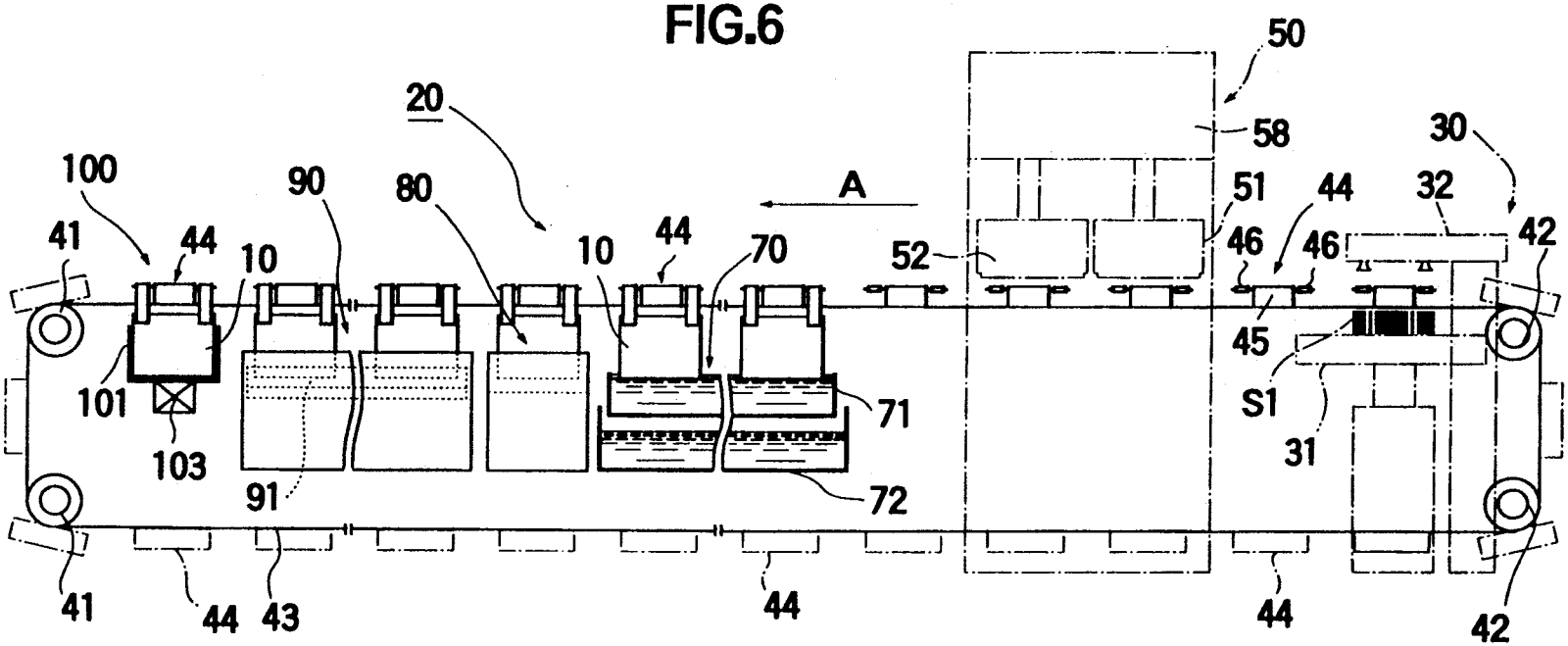

FIGS. 5 and 6 are a schematic plan view and a schematic side elevational view showing an apparatus for integrally forming the cutter according to the present invention.

Referring to FIGS. 5 and 6, a forming apparatus 20 comprises: a workpiece station 30 on which stacks $S_1$, $S_2$ of the carton boards 10 are placed; a transfer device 40 which successively transfers the carton boards 10 along a predetermined path; a die-cutting machine 50 which forms the saw-toothed edge portion 6'' on the respective carton boards 10; a dust collector 60 which collects the small pieces of paper 13, 14 and dust generated during die-casting; a dipping vat 70 filled with a quick drying adhesive; a blowing and recycling device 80 which blows air over the saw-toothed edge portion 6'' of the respective carton boards 10 to remove drops of adhesive from the edge portion 6" and recycles the removed adhesive; a drying device 90 which dries the edge portion6" impregnated with the adhesive; and a product station 100 where the carton blanks 10 formed with integral cutters 6 are accumulated.

The workpiece station 30 has a turntable 31 which can be raised and lowered and on which the stacks $S_1$, $S_2$ of carton boards 10 are placed. The station 30 also has a photoelectric detector (not shown) which detects the height of the stacks. In FIG. 5, the stack 5, is located in a supply position from which the carton boards 10 can be supplied to the transfer device 40, whilst the stack $S_2$ is located in a standby position at which an additional new stack of the carton boars 10 can be supplied, either manually or by a device for this purpose. The workpiece station 30 also has a pickup mechanism 32, which sucks and holds the uppermost carton board 10 of the stack $S_1$ on the turntable 31 and removes it therefrom, and then, move this carton board 10 horizontally to a position at which the transfer device 40 can grip it.

The transfer device 40 has driven sprockets 41, 41 which are rotated by the a driving means 49, follower sprockets 42 which are rotatably mounted on a frame (not shown), and an endless conveyor belt 43 which is wound around these sprockets 41, 42. The transfer device 40 also has a plurality of chucking devices 44 disposed on the conveyor belt 43 at a predetermined distance from each other, and the driving means 49, which may be an electric motor, for driving the conveyor belt 43 by means of the driven sprockets 41, 41. In FIG. 6, the chucking devices 44 gripping the carton boards 10 are shown in solid lines, and the chucking devices 44 not gripping carton boards 10 are shown in phantom lines.

The driven sprockets 41, 41 are instantaneously stopped after being driven for a predetermined time by the drive means 49, and this movement is repeated. This intermittent movement of the sprockets 41 causes the conveyor belt 43 to advance in the direction as indicated by the arrow A in FIG. 5, by a distance corresponding to the distance between adjacent chucking devices 44 during each period of movement.

Figure 7:
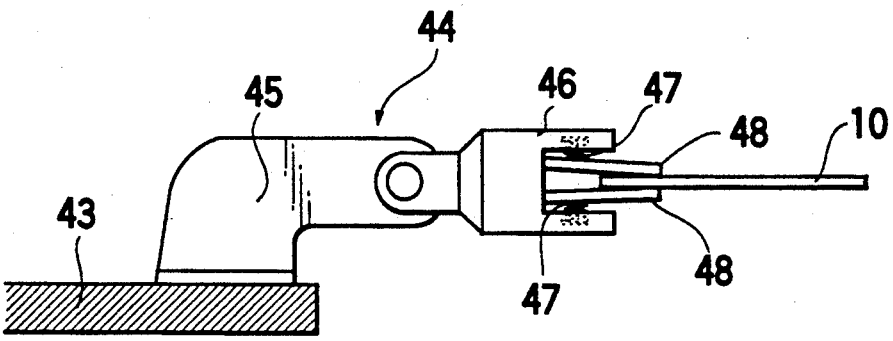
FIGS. 7 and 8 are front elevational views of a chucking device shown in FIGS. 5 and 6.
Figure 8:
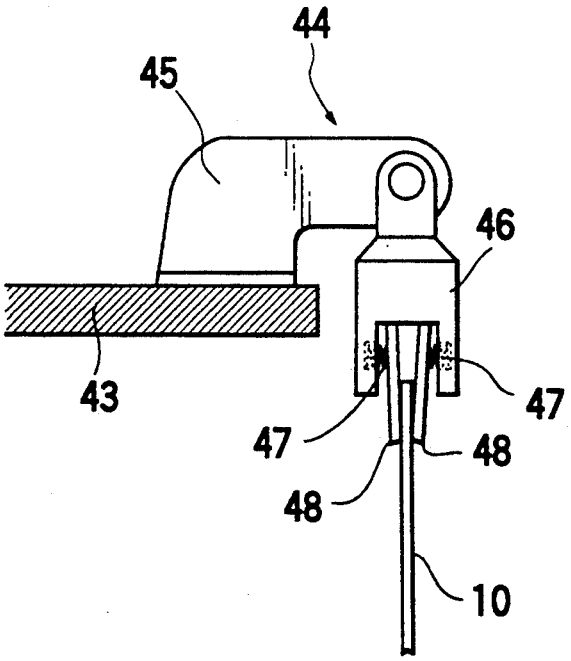

FIGS. 7 and 8 are front elevational views of the chucking device 44.

The chucking devices 44 are carried on the conveyor belt 43 at a predetermined spacing. Each chucking device 44 includes a pair of carriers 45, 45 fixed on the upper surface of the conveyor belt 43, and a pair of chuck bodies 46, 46 mounted on the respective carriers 45, 45 pivotably about an axis parallel to the direction of travel of the conveyor belt 43. Each of the chuck bodies 46 has a pair of compression springs 47, 47 and a pair of chucks 48, 48, which are biased against each other by the springs 47, 47 so that the chucks 48, 48 are normally closed. The chuck body 46 is connected to a fluid-operated cylinder (not shown), for selectingly pivoting the chuck body 46 between its horizontal orientation as shown in FIG. 7 and its verlical orientation shown in FIG. 8, and for opening the chucks 48, 48 against the springs 47, 47. The fluid-operated cylinder is adapted to be operated by a fluid control circuit (not shown).

The die-cutting machine 50 is a kind of die-cutting press and has a pair of holders 51, 52, a counter table 59 (FIG. 9), and a lifting and lowering means 58 for the holders 51, 52. The die-cutting machine 50 is so arranged that its cutting blades held by the holder 51, 52 can die-cut the edge portion 6' of the carton board 10 by the pressing action of the die-cutting machine 50, thereby forming a saw-toothed edge portion 6" thereon.

Figure 9:
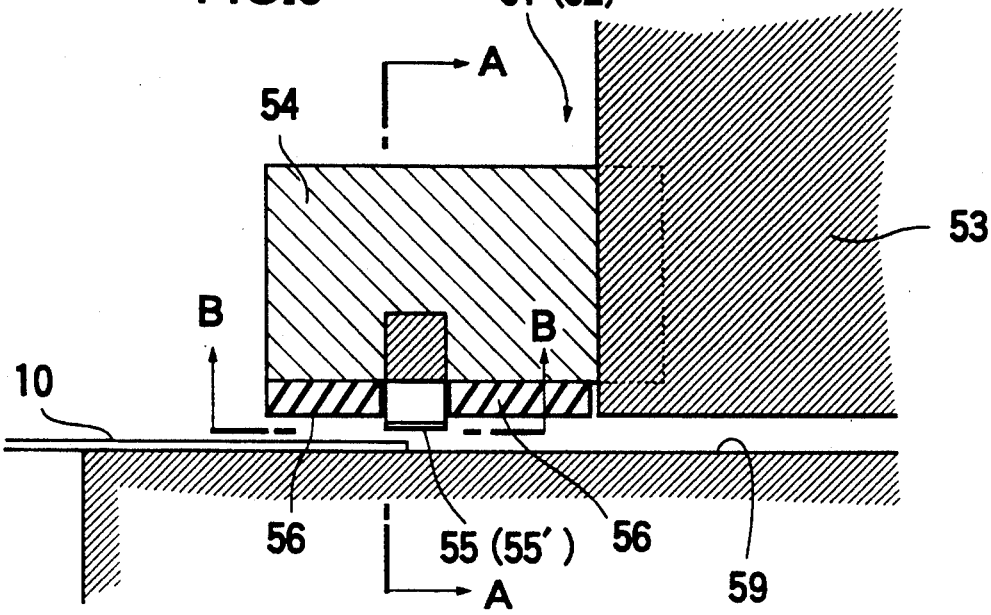
FIG. 9 is an enlarged vertical cross-sectional view showing the mechanism associated with the blades of the apparatus of FIGS. 5 and 6, and FIGS. 9A and 9B are cross-sectional views taken along lines A—A and B—B of FIG. 9 respectively.
Figure 9A:
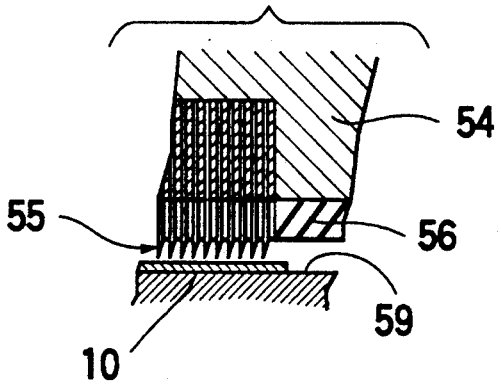
Figure 9B:
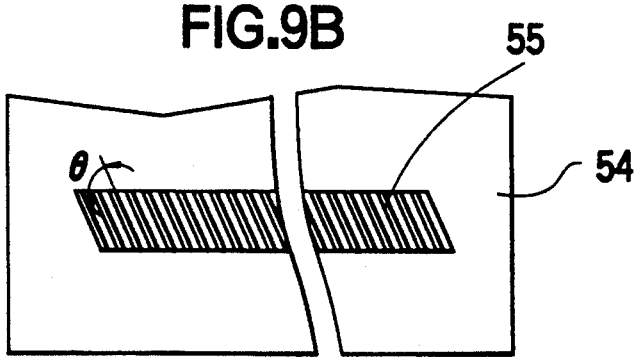

FIG. 9 is an enlarged vertical cross-sectional view showing the mechanism associated with the blades, and FIGS. 9A and 9B are cross-sectional views taken along lines A—A and B—B of FIG. 9.

Referring to FIG. 9, the holder 51 has a carrying device 53 which is integrally connected with piston rods of the lifting and lowering means 58 by means of an adjusting mechanism (not shown) for adjusting its relative horizontal position. A holding tool 54 is mounted on the carrying device 53 by mean of an adjusting mechanism (not shown) for adjusting its relative vertical position. Further, a plurality of steel cutting blades are secured to the holding tool 54. Each of the cutting blades has a blade tip 55 at its lower portion. The lower surface of the holding tool 54 is equipped with pressing pads 56, 56.

FIG. 9, the carrying device 53 is illustrated in the raised position from which it can be lowered at a predetermined period of time so that the blade tips 55 are brought into close proximity with the counter table 59. Further, the horizontal position of the carrying device 53 relative to the lifting and lowering means 58 can be adjusted by the aforementioned adjusting mechanism, and therefore, the horizontal position of the blade tips 55 can be corrected by fine adjustment of the carrying device 53.

The blade tips 55 is moved upward and downward together with the holding tool 54 by the lifting and lowering movement of the carrying device 53. The vertical position of the holding tool 54 relative to the carrying device 53 can be adjusted by the aforementioned adjusting mechanism, and therefore, the vertical position of the blade tips 55 can be corrected by fine adjustment of the holding tool 54.

The blades are supported by a lower portion of the holding tool 54 at a predetermined spacing and depend therefrom such that the blade tips 55 protrude from the lower surfaces of the pressing pads 56, 56. Further, the blade tips 55 are positioned on the holding tool 54 so as to be directed at a predetermined angle $\Theta$ with respect to the longitudinal axis of holding tool 54, and therefore, blade tips 55 are able to form the slits 11 on the carton board 10, as shown in FIG. 2A.

The blade tips 55' provided on the holding tool 54 of the holder 52 are arranged in a symmetrical relation to the blade tips 55 on the holder 51, so that the blades 55' are able to form the slits 12 on the carton board 10, as shown in FIG. 2B.

The pressing pads 56,56 are used for holding the carton board 10 in position during the die-cutting action of the blade tips 55. For this purpose, the pressing pads 56,56 are attached to the lower surface of the holding tool 54 so that they are elastically forced onto the carton board 10 to press it against the counter table 59 during the lowering movement of the holding tool 54.

The dust collector 60 has a suction tube 61 extending from the body thereof, and suction nozzles 62,63 are provided on the suction tube 61, as shown in FIG. 5. The suction nozzles 62, 63 open to an area around the holder 51, 52, so that the dust collector 60 can collect dust and small pieces of paper 13, 14 generated during the die-cutting by the blade tips 55, 55'.

Figure 10:
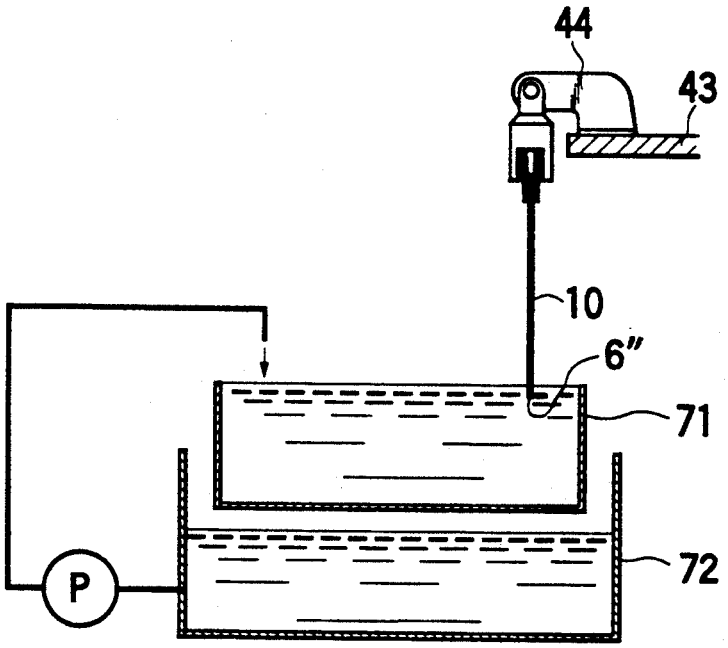
FIG. 10 is an enlarged vertical cross-sectional view of a dipping vat shown in FIGS. 5 and 6.

FIG. 10 is an enlarged cross-sectional view of the dipping vat 70. The dipping vat 70 has a double bottom construction comprising an overflow tank 71 to be fed with the quick drying adhesive and a reservoir 72 to receive the adhesive overflowing from the overflow tank 71. The overflow tank 71 is situated at a predetermined height so that when the carton board 10 is held in its vertical orientation saw-toothed edge portion 6' will be dipped in the adhesive bath up to the depth as indicated by the shading in FIG. 2C. The adhesive received by the reservoir 72 is returned to the overflow tank 71 by a return pump P.

The blowing and recycling device 80 is adapted to blow air at a preselected velocity over the saw-toothed edge portion 6" of the carton board 10 when it is passing therethrough with the carton board 10 being held in its vertical orientation. The air stream blows drops of adhesive off the edge portion 6" and the device 80 receives the drops and pumps them into reservoir 72 or the overflow tank 71.

The drying device 90 is provided with a pair of heaters 91, 92 positioned at opposite sides of the passage for the saw-toothed edge portion 6" of the carton board 10 and at a height corresponding to that of the edge portion 6". They dry the edge portion 6" as it passes through the carton board 10 held vertically. The heaters 91 and 92 are adapted to blow high temperature (e.g. 100° C. through 120° C.) air currents over the edge portion 6".

The product station 100 includes a pair of product containers 101 and 102 for receiving the carton boards 10 which have already been formed with die-cut, dipped and dried saw-toothed edge portions 6", that is, the carton blanks 10 having integral cutter 6. The product station 100 further includes a sliding mechanism 103 which causes the containers 101, 102 to move horizontally. The containers 101, 102 are horizontally and stepwisely moved by the sliding mechanism 103 in a direction transverse to the direction of the arrow A so as to receive the carton blanks 10 as they arrive. When one of the containers, e.g. the container 101 has accommodated the predetermined number of carton blanks 10, the other empty container 102 is moved into the transfer path of the carton blanks 10 by the sliding mechanism 103 and begins to receive the carton blanks 10.

The operation of the forming apparatus 20 will now be described.

The transfer device 40 causes the chucking device 44 to grip the carton board 10 sucked and held by the pickup mechanism 32, and then transfers it away from the workpiece station 30 in the direction of the arrow A while keeping it horizontal.

After the carton board 10 has been transferred to the position as shown in FIG. 5 and has rested there for a very short time, the die-cutting machine 50 lowers the holder 51 and the blade tips 55 to form the slits 11 (FIG. 2A) on the edge portion 6'. At the same time, the die cutting machine 50 lowers the holder 52 so as to cause the blade tips 55, to form the slits 12 ( FIG. 2B ) on the edge portion 6' of the preceding carton board 10, which was transferred up to the position II prior to said carton board 10 at position I and rested there for the same period of time. The carton board 10 which has been formed with the slits 11 is then transferred up to the position II by the transfer device 40, at which the carton board 10 is formed with the slits 12 by the blade tips 55' on the holder 52 in the very same manner as in the case of the preceding carton board 10.

Any dust and the small pieces of paper 13, 14 generated in this die-cutting process are sucked up by the dust collecter 60, and thus the carton board 10 is formed with the saw-toothed edge portion 6".

The overflow tank 71 of the dipping vat 70 is supplied with the quick drying adhesive so that the adhesive normally overflows therefrom. As soon as the board 10 passes over the rear end edge of the overflow tank 71 during its transfer to position III, the carton board 10 is swung down to its vertical orientation by a downward pivoting movement of the chuck bodies 46, 46 of the chucking device 44. As a result, the saw-toothed edge portion 6" is dipped in the bath of adhesive as shown in FIG. 10, and impregnated with the adhesive.

The carton board 10 having its edge portion 6" impregnated with the adhesive is swung slightly upward so that it can pass over the front end edge of the overflow tank 71, whereafter, it is transferred to the blowing and recycling device 80 and the drying device 90. After clearing the front end edge of the overflow tank 71, it is returned to its vertical orientation.

The blowing and recycling device 80 blows air onto drops of adhesive remaining at the bottoms of the V -shaped notches of the saw-toothed edge portion 6", and receives and recycles the drops falling off therefrom. The drying device 90 dries the edge portion 6" with air currents produced by the heaters 91, 92.

The carton board 10 thus formed with an integral cutter 6, that is, the carton blank 10, is transferred to position IV, at which it is released from the chucking device 44 and received by the container-101. After releasing the carton blank 10, the chucking device 44 is returned to the workpiece station 30 by the endless belt 43.

By use of the forming apparatus 20, it is possible to form the integral cutter 6 with respect to a large number of the carton boards 10, successively in a continuous processes. Further, the transfer rate of the carton boards 10 can be set at a substantially high rate, i.e, a rate for transferring the carton board 10 from one position to the next position can be set at one second ( that is, one pitch / sec.). In this case, the carton blanks 10 can be accumulated at the product station 100 and delivered therefrom as products at a output rate of 3600 pieces / hour.

Although particular embodiments have been described, they were for the purpose of illustrating, but not limiting, the invention. Various modifications, which will come readily to the mind of one skilled in the art, are within the scope of the invention as defined in the appended claims.

For example, in the aforementioned embodiments, the cutter 6 was provided on the edge portion 6' of the skirt 5F of the lid 4. However, the present invention is not directly concerned with the position of the cutter 6' and therefore, can be applied to carton blanks having various types, such as one having a cutter at the upper edge of the front side wall of the packaging container.

Further, practical design conditions, such as the transfer rate, the length of the dipping vat and the drying device and so forth, may be appropriately determined, depending on the properties of paper board material, the sort of adhesive and so forth.

Still further, in the above embodiments, the drying device 90 was provided with heaters 91, 92 of the hot-air type, but the drying device may be alternatively provided with heaters of the heat radiation type.

What is claimed is:

1. A method of integrally forming a cutter on a carton blank in which a paperboard is shaped into a profile substantially the same as that of the carton blank, the paperboard is integrally formed with saw-teeth on an edge portion thereof, and the teeth are hardened by application of a quick drying adhesive including α-cyanoacrylate, thereby producing a carton blank for a carton having an integral cutter, comprising:

forming a plurality of first slits on an edge portion of said paperboard at a predetermined angle relative to the edge;

forming a plurality of second slits on said edge portion of the paperboard at a predetermined angle relative to the first slits in such a manner that saw-teeth are formed on the edge; and hardening the teeth by application of said quick drying adhesive.

2. A method according to Claim 1, wherein small pieces of paper and dust generated during forming the second slits are sucked up, so that the pieces and dust are removed from said edge portion of the paperboard.

3. A method according to Claim 1, wherein air is blown over edge portion after application of the quick drying adhesive so that drops of the quick drying adhesive are removed therefrom before the edge portion is dried.

4. A method according to claim 1, wherein said paperboard includes a cover portion for enclosing the integral cutter, the cover portion being adapted for protecting the cutter from damage and contamination.

5. A method according to claim 1, wherein said paperboard includes a support portion for supporting the integral cutter in a predetermined position to protects it from damage and contamination.

* * * * *